US007513601B2

(12) United States Patent
Asai et al.

(10) Patent No.: US 7,513,601 B2
(45) Date of Patent: Apr. 7, 2009

(54) LIQUID DISCHARGE HEAD AND METHOD OF MANUFACTURING THE SAME

(75) Inventors: Kazuhiro Asai, Kanagawa (JP); Masahiko Kubota, Tokyo (JP); Ryoji Kanri, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 434 days.

(21) Appl. No.: 11/288,151

(22) Filed: Nov. 29, 2005

(65) Prior Publication Data

US 2006/0114295 A1 Jun. 1, 2006

(30) Foreign Application Priority Data

Dec. 1, 2004 (JP) ..... 2004-348614

(51) Int. Cl.
*B41J 2/14* (2006.01)

(52) U.S. Cl. ..... 347/47; 347/65; 347/63

(58) Field of Classification Search ..... 347/65, 347/94, 63, 85, 47; 29/890.1
See application file for complete search history.

(56) References Cited

U.S. PATENT DOCUMENTS

| | | | |
|---|---|---|---|
| 5,218,376 | A | 6/1993 | Asai |
| 6,095,640 | A | 8/2000 | Ishinaga et al. |
| 6,142,606 | A | 11/2000 | Kubota et al. |
| 6,155,673 | A | 12/2000 | Nakajima et al. |
| 6,158,843 | A | 12/2000 | Murthy et al. |
| 6,196,667 | B1 | 3/2001 | Hiroki et al. |
| 6,374,482 | B1 | 4/2002 | Mihara et al. |
| 6,378,993 | B1 | 4/2002 | Ozaki et al. |
| 6,386,686 | B1 | 5/2002 | Kubota et al. |
| 6,426,481 | B1 | 7/2002 | Koide et al. |
| 6,435,661 | B1 | 8/2002 | Inoue et al. |
| 6,435,670 | B1 | 8/2002 | Inoue et al. |
| 6,439,700 | B1 | 8/2002 | Ishinaga et al. |
| 6,464,342 | B1 | 10/2002 | Kubota et al. |
| 6,464,345 | B2 | 10/2002 | Kubota et al. |
| 6,485,132 | B1 | 11/2002 | Hiroki et al. |
| 6,488,364 | B1 | 12/2002 | Nakajima et al. |

(Continued)

FOREIGN PATENT DOCUMENTS

| | | |
|---|---|---|
| JP | 4-10940 | 1/1992 |

(Continued)

*Primary Examiner*—Matthew Luu
*Assistant Examiner*—Henok Legesse
(74) *Attorney, Agent, or Firm*—Fitzpatrick, Cella, Harper & Scinto

(57) ABSTRACT

With the liquid discharge head, a discharge speed of liquid droplets is increased, a discharge amount of liquid droplets is stabilized, and a discharge efficiency of the liquid droplets is enhanced. A bubbling chamber has a first bubbling chamber which is connected to a supply path with a main surface of an element substrate forming a bottom surface thereof and in which bubbles are generated in ink by a heater, and a second bubbling chamber connected to the first bubbling chamber. Moreover, a nozzle has a discharge port portion including a discharge port connected to the second bubbling chamber. Assuming that an average sectional area of the first bubbling chamber is S1, an average sectional area of the second bubbling chamber is S2, and an average sectional area of the discharge port portion is S3 in sections parallel to the main surface of the element substrate, the nozzle satisfies a relation of S2>S1>S3.

9 Claims, 8 Drawing Sheets

U.S. PATENT DOCUMENTS

| | | | | |
|---|---|---|---|---|
| 6,491,380 | B2 | 12/2002 | Taneya et al. | |
| 6,497,475 | B1 | 12/2002 | Kubota et al. | |
| 6,533,400 | B1 | 3/2003 | Kudo et al. | |
| 6,540,330 | B1 | 4/2003 | Kubota et al. | |
| 6,766,817 | B2 | 7/2004 | da Silva | |
| 6,786,572 | B2 | 9/2004 | Imanaka et al. | |
| 6,799,838 | B2 | 10/2004 | Kubota et al. | |
| 6,854,831 | B2 | 2/2005 | Kubota et al. | |
| 6,910,760 | B2 | 6/2005 | Kubota et al. | |
| 6,945,635 | B2 | 9/2005 | Kubota et al. | |
| 6,971,171 | B2 | 12/2005 | Komuro et al. | |
| 7,036,909 | B2 | 5/2006 | Kubota et al. | |
| 7,048,358 | B2 | 5/2006 | Kubota et al. | |
| 7,165,831 | B2 * | 1/2007 | Cornell et al. | 347/65 |
| 2001/0002135 | A1 * | 5/2001 | Milligan et al. | 347/65 |
| 2004/0021734 | A1 * | 2/2004 | Otsuki | 347/43 |
| 2006/0098051 | A1 | 5/2006 | Kubota et al. | |
| 2006/0114295 | A1 | 6/2006 | Asai et al. | |
| 2006/0125877 | A1 | 6/2006 | Kubota et al. | |
| 2006/0125884 | A1 | 6/2006 | Sato et al. | |
| 2006/0277755 | A1 | 12/2006 | Kubota et al. | |

FOREIGN PATENT DOCUMENTS

| | | |
|---|---|---|
| JP | 4-10941 | 1/1992 |

* cited by examiner

LIQUID DISCHARGE HEAD AND METHOD OF MANUFACTURING THE SAME

BACKGROUND OF THE INVENTION

1. Field of the Invention

The present invention relates to a liquid discharge head for discharging liquid droplets such as ink droplets to record an image on a recording material, and a method of manufacturing the head, more particularly to a liquid discharge head which records an image in an ink jet recording system.

2. Related Background Art

An ink jet recording system is one of so-called non-impact recording systems. In this ink jet recording system, noises generated during the recording are so small that they can be ignored, and high-speed recording is possible. In the ink jet recording system, the recording is possible with respect to various recording materials, ink is fixed to even so-called plain paper without requiring any special treatment, and a high-definition image can be obtained inexpensively. From such advantage, in recent years, the ink jet recording system has rapidly spread as not only a printer which is a peripheral of a computer but also recording means such as a copying machine, a facsimile machine, or a word processor.

As an ink discharge method of the ink jet recording system, there is a method in which an electrothermal transducing element such as a heater is used as a discharge energy generating element for use in discharging ink droplets. A principle is that a voltage is applied to the electrothermal transducing element to thereby bring the ink in the vicinity of the electrothermal transducing element to boil momentarily. Bubbles rapidly grow owing to a phase change of the ink during the boiling to thereby discharge the ink droplets at a high speed.

In Japanese Patent Application Laid-Open No. 4-10941, a discharge method is disclosed in which bubbles generated by driving the electrothermal transducing element in response to a recording signal are vented to outside air. Examples of a typical constitution for venting the bubbles to the outside air include a constitution in which the shortest distance between the electrothermal transducing element and a discharge port is largely shortened as compared with a conventional constitution.

There is a demand for a further increase of a recording speed in order to achieve a higher image quality output of a recorded image, a high quality level image, a high resolution output and the like with respect to a recording device provided with the above-described liquid discharge head.

In U.S. Pat. No. 6,158,843, there is disclosed a constitution in which a space where an ink channel is locally narrowed or a protrusion-like fluid resistant element is disposed in the vicinity of a supply port to thereby improve a flow of ink from the supply port to a supply path. According to such constitution, a discharge frequency can be enhanced, and the recording speed can be increased.

Additionally, in the above-described conventional liquid discharge head, when the ink droplets are discharged, a part of the ink with which a bubbling chamber is filled is pushed back into the supply path by means of the bubbles growing in the bubbling chamber. Therefore, the conventional liquid discharge head has a disadvantage that a discharge amount of ink droplets decreases with a decrease of a volume of the ink in the bubbling chamber.

Moreover, in the conventional liquid discharge head, in a case where a part of the ink with which the bubbling chamber is filled is pushed back into the supply path, a part of a pressure of the growing bubbles opposed to the side of the supply path escapes toward the supply path, or a pressure loss is generated by friction between an inner wall of the bubbling chamber and the bubbles. Therefore, the conventional liquid discharge head has a problem that a discharge speed of the ink droplets drops with a decrease of the pressure of the bubbles.

Furthermore, in the conventional liquid discharge head, a size of the discharge port is miniaturized in order to obtain the higher image quality output, higher quality level image, higher resolution output and the like. Therefore, there is a problem that the discharged ink is easily secured to the discharge port. The conventional liquid discharge head also has a problem that the ink discharged up to the discharge port is evaporated by atmospheric air on the surface of the discharge port, viscosity of the ink fluctuates, and discharge defects are generated.

SUMMARY OF THE INVENTION

An object of the present invention is to provide a liquid discharge head which can increase a discharge speed of liquid droplets, stabilize a discharge amount of the liquid droplets, and enhance a discharge efficiency of the liquid droplets, and a method of manufacturing the head.

To achieve the above-described object, according to the present invention, there is provided a liquid discharge head comprising: a discharge energy generating element which generates energy for discharging liquid droplets; an element substrate on which the discharge energy generating element is disposed; and an orifice substrate having a nozzle for discharging the liquid droplets and a supply chamber for supplying a liquid to the nozzle and bonded to a main surface of the element substrate. The nozzle has a discharge port to discharge the liquid droplets, a bubbling chamber in which bubbles are generated by the discharge energy generating element, and a supply path for supplying the liquid to this bubbling chamber. The bubbling chamber has: a first bubbling chamber which is connected to the supply path while the main surface of the element substrate is a bottom surface and in which the bubbles are generated in the liquid by the discharge energy generating element; and a second bubbling chamber connected to the first bubbling chamber. Moreover, the nozzle has a discharge port portion including the discharge port connected to the second bubbling chamber. Assuming that an average sectional area of the first bubbling chamber is S1, an average sectional area of the second bubbling chamber is S2, and an average sectional area of the discharge port portion is S3 in a section parallel to the main surface of the element substrate, the nozzle satisfies a relation of S2>S1>S3.

As described above, according to the liquid discharge head of the present invention, since the average sectional area of the second bubbling chamber is set to be larger than that of the first bubbling chamber, the liquid is inhibited from being evaporated on the surface of the discharge port, and discharge impossibility due to thickening of the liquid can be avoided to enhance stability of a discharge operation. Furthermore, according to the present invention, it is possible to enhance a degree of freedom of a component or viscosity of a liquid for use, and printing with a more satisfactory quality level is possible. Consequently, it is possible to enhance liquid discharge characteristics and enhance reliability of the discharge operation.

DESCRIPTION OF THE PREFERRED EMBODIMENTS

There will be described hereinafter typical embodiments of a liquid discharge head which discharges droplets of a liquid such as ink according to the present invention in detail with reference to the drawings.

First, an outline of the liquid discharge head will be described according to the present embodiment. In the present embodiment, the liquid discharge head is an ink jet recording head which is provided with means for generating heat energy as energy for use in discharging liquid ink and in which a system is adopted to cause a state change of the ink by the heat energy. In the present embodiment, heat generating resistant element is used as the means for generating the heat energy, and the ink is discharged utilizing a pressure due to bubbles generated when the ink is heated by the heat generating resistant element to boil a film.

As described later in detail, the liquid discharge head has a constitution in which a partition wall for individually and independently forming nozzles as ink channels is extended from a discharge port to the vicinity of a supply port in each of a plurality of heaters as the heat generating resistant elements. Such liquid discharge head has ink discharge means to which an ink jet recording system is applied as disclosed in, for example, Japanese Patent Application Laid-Open Nos. H04-10940 and H04-10941, and the bubbles generated during the discharging of the ink are vented to outside air through the discharge port.

Figure 1:
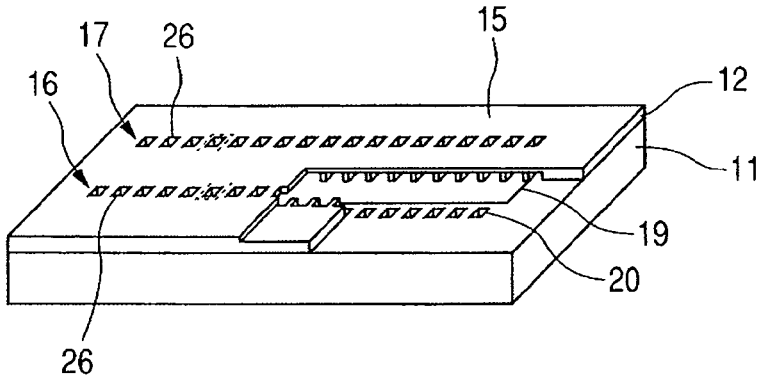
FIG. 1 is a perspective view showing an outline of a liquid discharge head according to an embodiment.

Moreover, as shown in FIG. 1, the liquid discharge head is provided with: a first nozzle row 16 which has a plurality of heaters and nozzles and in which longitudinal directions of the respective nozzles are arranged in parallel with one another; and a second nozzle row 17 which is disposed in a position facing the first nozzle row 16 through a supply port 36.

In each of the first and second nozzle rows 16 and 17, an interval between the adjacent nozzles is set to a pitch of 600 dpi. The second and first nozzle rows 17 and 16 are arranged in such a manner that the pitch between the adjacent nozzles of the second nozzle row dethroughtes by a ½ pitch from that between the adjacent nozzles of the first nozzle row.

Moreover, the first and second nozzle rows 16 and 17 are constituted in such a manner that discharge amounts of ink droplets discharged from the discharge ports differ from each other. The first nozzle row 16 is different from the second nozzle row 17 in an opening area of each discharge port and an area of the heater parallel to a main surface of the element substrate described later. Furthermore, the first and second nozzle rows 16 and 17 are formed so as to have an equal shortest distance between the heater and the discharge port.

Here, there will be briefly described a concept to optimize the liquid discharge head provided with the first and second nozzle rows 16 and 17 in which a plurality of heaters and nozzles are arranged with a high density.

In general, as physical amounts that influence discharge characteristics of the liquid discharge head, an inertance (inertia force) and a resistance (viscosity resistance) in the plurality of nozzles largely act. Dynamic equations of a non-compressive fluid which moves in a channel having an arbitrary shape are represented by the following two equations:

$$\Delta \cdot v = 0 \text{(equation of continuity} \qquad \text{Equation 1;}$$

and $$(\partial v/\partial t)+(v\cdot\Delta)v=-\Delta(P/\rho)+(\mu/\rho)\Delta^2 v+f\text{(Navier Stokes equation)} \qquad \text{Equation 2.}$$

When Equations 1 and 2 are approximated assuming that a convection term and a viscosity term are sufficiently small and there is not any external force, the following equation results:

$$\Delta^2 P=0 \qquad \text{Equation 3, and}$$

a pressure is represented using a harmonic function.

Figure 2:
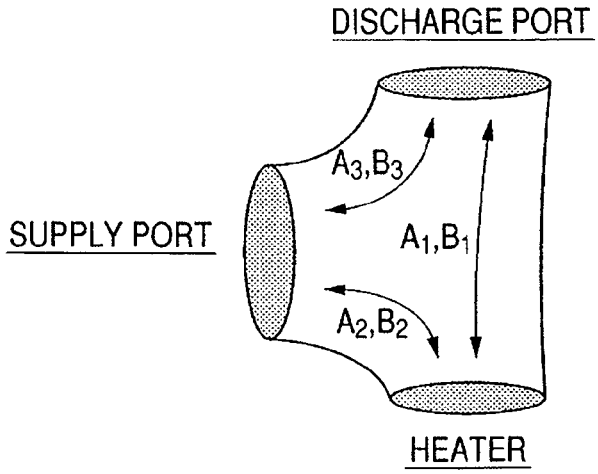
FIG. 2 is a schematic diagram showing a three-opening model of the liquid discharge head according to the present embodiment.
Figure 3:
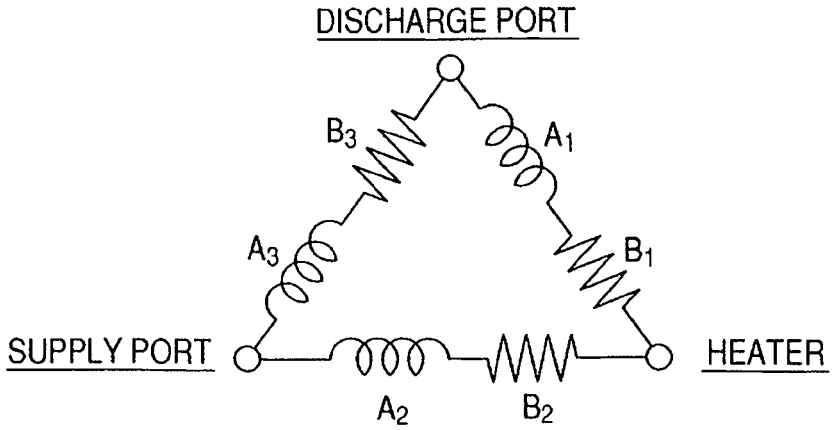
FIG. 3 is a schematic diagram showing an equivalent circuit of the liquid discharge head according to the present embodiment.

Moreover, the liquid discharge head is represented by a three-opening model shown in FIG. 2, and an equivalent circuit shown in FIG. 3.

The inertance is defined as "difficulty in moving" at a time when a static fluid rapidly starts moving. When the inertance is electrically represented, it has a function similar to that of inductance L which obstructs a change of a current. A mechanical spring mass model corresponds to a weight (mass).

When the inertance is represented by an equation, it is represented by a two-stage time differential of a fluid volume V at a time when a pressure difference is imparted to an opening, that is, a ratio of a flow rate F ($=\Delta V/\Delta t$) to a time differential.

$$(\Delta^2 V/\Delta t^2)=(\Delta F/\Delta t)=(1/A)\times P \qquad \text{Equation 4,}$$

wherein A: inertance.

For example, assuming a pipe channel having a density ρ, a length L, and a sectional area $S_0$ in a pseudo manner, an inertance $A_0$ of this pseudo one-dimensional pipe channel is represented by:

$$A_0=\rho\times L/S_0.$$

It is seen that the inertance is proportional to the length of the channel, and inversely proportional to the sectional area.

The discharge characteristics of the liquid discharge head can be predicted and analyzed as a model based on the equivalent circuit shown in FIG. 3.

In the liquid discharge head of the present invention, a discharge phenomenon is regarded as a phenomenon in which an inertial flow shifts to a viscous flow. In an initial stage of bubbling in the bubbling chamber by the heater, the inertial current is principal. Conversely, in a later stage of the discharging (i.e., a time from a time when a meniscus generated in the discharge port starts moving toward the ink channel until the ink is charged up to an opening end surface of the discharge port and returned by a capillary phenomenon), the viscous flow is principal. In this case, from the above-described relational equation, there is a large contribution to the discharge characteristics, especially a discharge volume and a discharge speed owing to a relation between the inertance amounts in the initial stage of the bubbling. In the later stage of the discharging, a resistance (viscosity resistance) amount largely contributes to the discharge characteristics, especially a time required for refilling the ink (hereinafter referred to as the refill time).

Here, the resistance (viscosity resistance) is represented by Equation 1 and a constant Stokes flow represented by the following equation:

$$\Delta P=\eta\Delta^2\mu \qquad \text{Equation 5.}$$

A viscosity resistance B can be obtained. In the later stage of the discharging, in a model shown in FIG. 2, the meniscus is generated in the vicinity of the discharge port, and an ink flow is generated by a suction force mainly due to a capillary force. Therefore, the resistance can be approximated by a two-opening model (one-dimensional flow model).

That is, the resistance can be obtained by a poiseuille equation 6 in which a viscous fluid is described:

$$(\Delta V/\Delta t)=(1/G)\times(1/\eta)\{(\Delta P/\Delta x)\times S(x)\} \qquad \text{Equation 6,}$$

wherein G: shape factor. Since the viscosity resistance B is attributable to the fluid flowing in accordance with an arbitrary pressure difference, the resistance is obtained by:

$$B=\int_0^L\{(G\times\eta)/S(x)\}\Delta x \qquad \text{Equation 7.}$$

According to Equation 7, assuming the pipe channel having the density ρ, length L, and sectional area $S_0$, the resistance (viscosity resistance) is represented by:

$$B=8\eta\times L/(\pi\times S_0^2) \qquad \text{Equation 8.}$$

The resistance is approximately proportional to the length of the nozzle, and inversely proportional to a square of the sectional area of the nozzle.

To enhance all of the discharge characteristics of the liquid discharge head, especially the discharge speed, discharge volume of the ink droplets, and refill time, the followings are necessary and sufficient conditions from the inertance relation. The conditions are that the inertance amount from the heater toward the discharge port is set to be as large as possible as compared with the inertance amount from the heater toward the supply port, and the resistance in the nozzle is reduced. The liquid discharge head according to the present invention can satisfy both of the above-described viewpoint and a proposition to arrange the plurality of heaters and nozzles with the high density.

Next, there will be described a typical constitution of the liquid discharge head according to the present embodiment with reference to the drawings.

Figure 4:
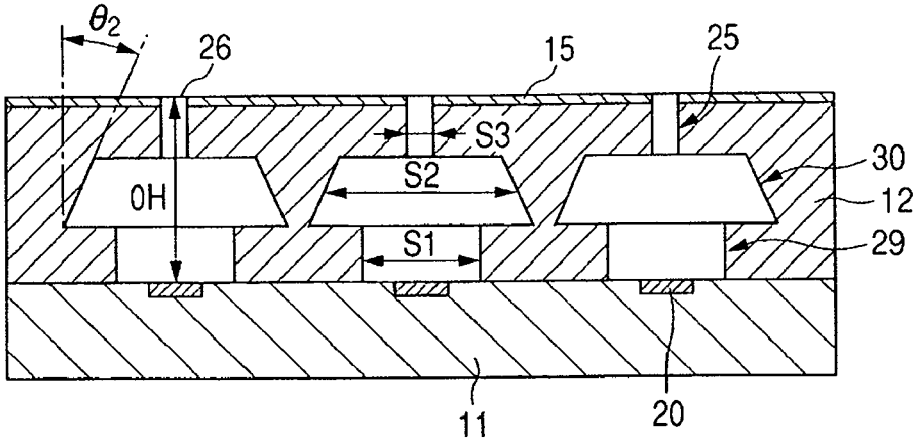
FIG. 4 is a vertically sectional view showing a structure of the liquid discharge head according to the present embodiment.
Figure 5:
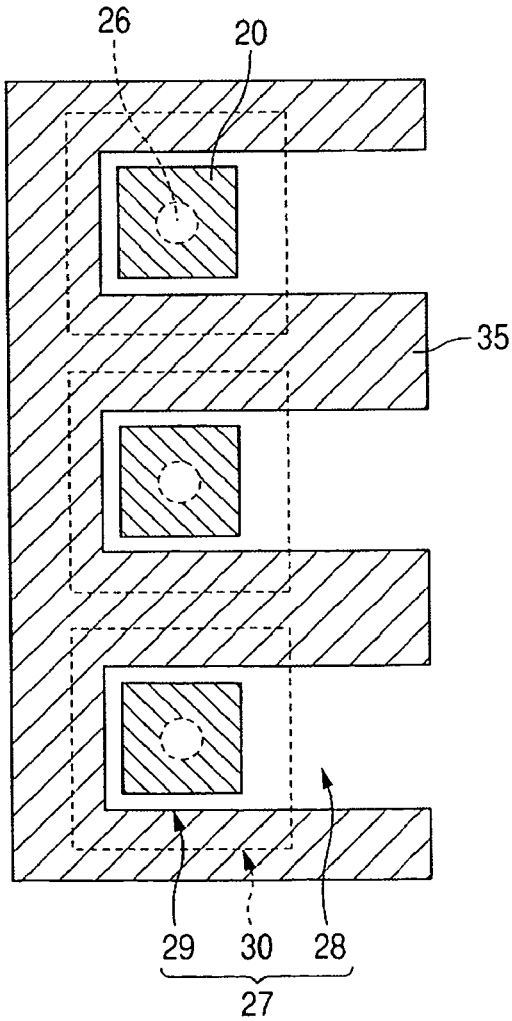
FIG. 5 is a perspective plan view showing the structure of the liquid discharge head according to the present embodiment.

As shown in FIGS. 4 and 5, the liquid discharge head is provided with: an element substrate 11 on which heaters 20 as a plurality of discharge energy generating elements that are heat generating resistant elements are disposed; and an orifice substrate 12 laminated and bonded to a main surface of the element substrate 11 to constitute a plurality of ink channels.

The element substrate 11 is formed of, for example, glass, ceramic, resin, metal or the like, and is generally formed of Si.

On the main surface of the element substrate 11, there are arranged: the heater 20 disposed for each ink channel; an electrode (not shown) which applies a voltage to the heater 20; and a wiring line (not shown) constituting a predetermined wiring line pattern electrically connected to the electrode. It is to be noted that, for example, a piezoelectric element (not shown) may be used instead of the heater 20. When the voltage is applied to the piezoelectric element, the piezoelectric element is displaced, and the ink droplets are discharged by a pressure generated by this displacement.

Moreover, on the main surface of the element substrate 11, an insulating film (not shown) to enhance a diffusing property of accumulated heat is disposed to cover the heater 20. Further on the main surface of the element substrate 11, a protective film (not shown) for protecting the main surface from cavitation generated at a time when the bubbles disappear is disposed to cover the insulating film.

The orifice substrate 12 is formed of a resin material into a thickness of about 20 to 75 μm. As shown in FIGS. 4 and 5, the orifice substrate 12 has a plurality of discharge ports 26 which discharge ink droplets, and a plurality of nozzles 27 in which the ink flows.

Moreover, the element substrate 11 is provided with a supply chamber 18 having a supply port 19 for supplying the ink to each nozzle 27 from a back-surface side of the main surface of the element substrate adjacent to the orifice substrate 12.

Each nozzle 27 has: a discharge port portion 25 including the discharge port 26; a first bubbling chamber 29 in which bubbles are generated in the ink by the heater 20; a second bubbling chamber 30 which connects the discharge port portion 25 to the first bubbling chamber 29; and a supply path 28 for supplying the ink to the first bubbling chamber 29.

Furthermore, as shown in FIG. 5, each heater 20 is surrounded with a nozzle wall 35 which individually divides a plurality of nozzles 27 arranged in parallel with one another in three directions, and one direction communicates with the supply path 28.

Each discharge port portion 25 is connected to an opening in an upper end surface of the second bubbling chamber 30, and a stepped portion is formed between a side wall surface of the discharge port portion 25 and that of the second bubbling chamber 30.

Each discharge port 26 of the discharge port portion 25 is formed in a position facing the heater 20 disposed on the element substrate 11. In the present embodiment, the discharge port 26 is formed into a round hole having a diameter of, for example, about 7 μm. It is to be noted that the discharge port 26 may be formed into a substantially radiating star shape if necessary for the discharge characteristics.

As shown in FIG. 4, the side wall surface of the second bubbling chamber 30 is inclined in a range of a tilt angle θ2 of 10° to 45° with respect to a plane crossing the main surface of the element substrate 11 at right angles, in other words, a plane crossing a thickness direction of the orifice substrate 12 at right angles. Moreover, as to a section parallel to the main surface of the heater 20, a sectional area is reduced toward the discharge port 26. The upper end surface of the second bubbling chamber 30 is connected to an opening in a lower end of the discharge port portion 25 through the stepped portion.

In general, in a case where the bubbling chamber is formed by etching, when the tilt angle θ2 is in a range of 10° to 45°, the side wall surface can be inclined to form the chamber easily. Moreover, since the side wall surface is inclined in this range, the ink can satisfactorily flow toward the discharge port 26 in the nozzle 27, pressure losses of the bubbles are reduced, and a discharge speed can be enhanced.

In the above-described constitution of the nozzle 27, the side wall surface of the first bubbling chamber 29 and the wall surface of the discharge port portion 25 are formed in parallel with a direction crossing the main surface of the heater 20 at right angles, and the only side wall surface of the second bubbling chamber 30 is inclined at the tilt angle θ2. The side wall surface of the first bubbling chamber 29 and the wall surface of the discharge port portion 25 may be inclined at a desired tilt angle in the same manner as in the side wall surface of the second bubbling chamber 30.

As another constitution of the nozzle 27, there will be described hereinafter a constitution in which the side wall surface of the first bubbling chamber 29 and the wall surface of the discharge port portion 25 are inclined. It is to be noted that in the other constitution of the nozzle 27, even bubbling chambers and discharge port portions having different shapes are denoted with the same reference numerals as those of the above-described constitution for the sake of convenience.

Figure 6:
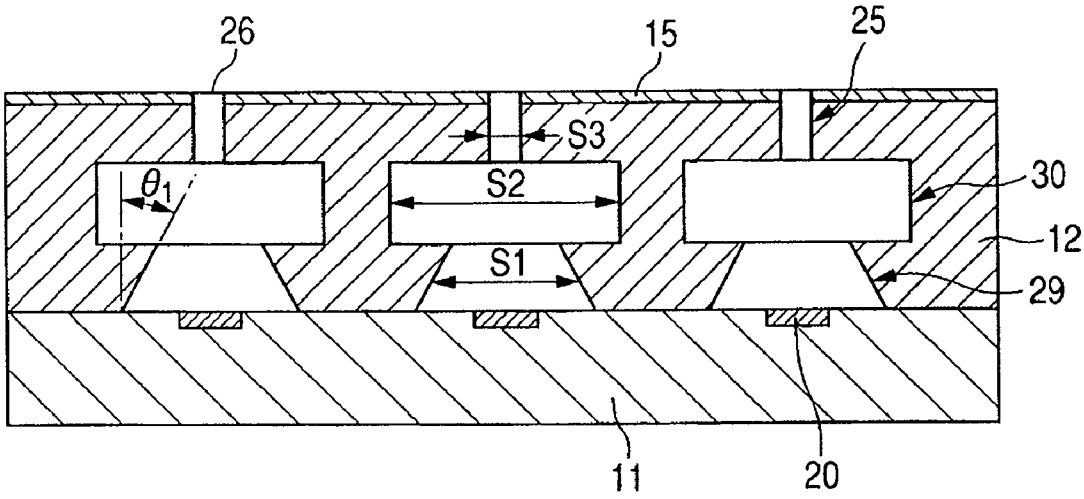
FIG. 6 is a vertically sectional view showing another example of a first bubbling chamber.

In the other constitution of the nozzle 27, as shown in FIG. 6, the side wall surface of the first bubbling chamber 29 is inclined in a range of a tilt angle θ1 of 10° to 45° with respect to a plane crossing a main surface of the element substrate 11 at right angles, and a sectional area of a section parallel to the main surface of the heater 20 is reduced toward the discharge port 26. The upper end surface of the first bubbling chamber 29 is connected to the opening in the lower end of the second bubbling chamber 30 through the stepped portion.

Moreover, in at least a part of the supply path 28, the side wall surface of the supply path 28 is similarly in a range of a tilt angle of 10° to 45°, and a sectional area of a section parallel to the main surface of the element substrate 11 is reduced toward the surface of the orifice substrate 12 positioned on the side of the discharge port 26. In other words, in at least a part of the supply path 28, a width of the supply path 28 on the plane crossing an ink flow direction at right angles is changed along a thickness direction of the orifice substrate 12.

Figure 7:
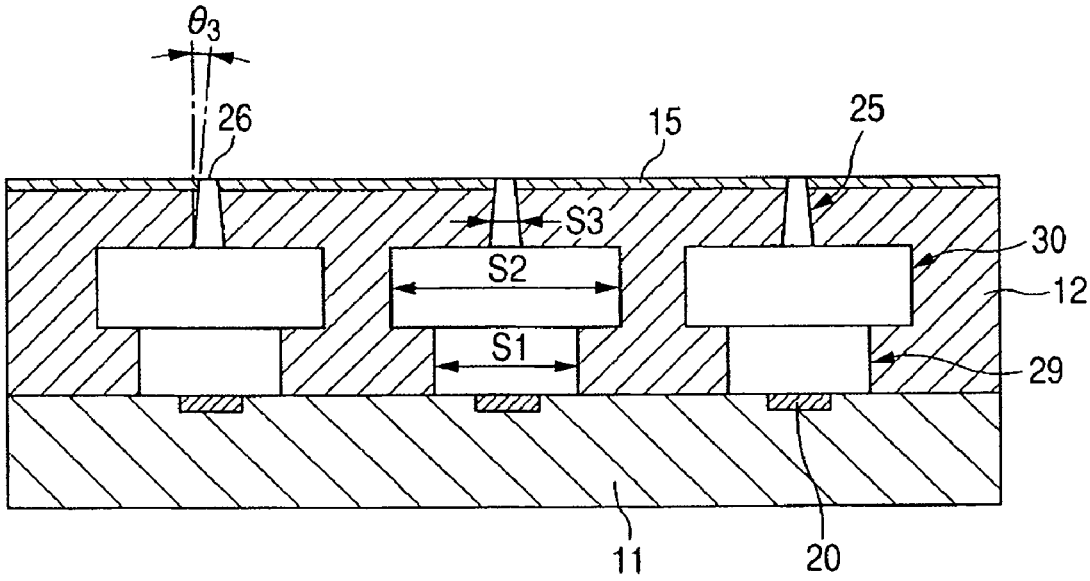
FIG. 7 is a vertically sectional view showing another example of a discharge port portion.

In still another constitution of the nozzle 27, as shown in FIG. 7, the wall surface of the discharge port portion 25 is inclined at a tilt angle θ1 of 10° or less with respect to the plane crossing the main surface of the element substrate 11 at right angles, and the sectional area of the section parallel to the main surface of the heater 20 is reduced toward the discharge port 26. It is to be noted that in the nozzle 27 according to the above-described embodiment, if necessary, the constitutions may be combined in which the side wall surface of the first bubbling chamber 29, the side wall surface of the second bubbling chamber 30, and the wall surface of the discharge port portion 25 are inclined. Needless to say, the side wall surfaces of the first and second bubbling chambers 29 and 30 and the discharge port portion 25 may be formed in parallel with the direction crossing the main surface of the heater 20 at right angles, respectively.

Moreover, an average sectional area of the section of the second bubbling chamber 30 parallel to the main surface of the element substrate 11 is set to be larger than that of the first bubbling chamber 29, and a stepped shape is formed in a portion which connects the first bubbling chamber 29 to the second bubbling chamber 30. Furthermore, an average sectional area of the section of the first bubbling chamber 29 parallel to the main surface of the element substrate 11 is set to be larger than that of the discharge port 26, and a stepped shape is formed in a portion which connects the discharge port 26 to the second bubbling chamber 30.

That is, in the section of the nozzle 27 parallel to the main surface of the element substrate 11, an average sectional area S1 of the first bubbling chamber 29, an average sectional area S2 of the second bubbling chamber 30, and an average sectional area S3 of the discharge port portion 25 are formed into such a structure as to satisfy a relation of S2>S1>S3.

Moreover, the first bubbling chamber 29 is connected to the second bubbling chamber 30 through the stepped portion. In the section parallel to the main surface of the element substrate 11, the sectional area of the second bubbling chamber 30 is set to be larger than that of the first bubbling chamber 29. The second bubbling chamber 30 is connected to the discharge port 26 through the stepped portion. In the section parallel to the main surface of the element substrate 11, the sectional area of the second bubbling chamber 30 is set to be larger than that of the discharge port 26.

Moreover, the first bubbling chamber 29 is disposed along an extension of the supply path 28, and a bottom surface of the first bubbling chamber facing the discharge port 26 is formed into a substantially rectangular shape.

Here, the nozzle 27 is formed in such a manner that the shortest distance OH between the discharge port 26 and the main surface of the heater 20 parallel to the main surface of the element substrate 11 is 75 μm or less.

In the nozzle 27, the upper end surface of the first bubbling chamber 29 parallel to the main surface of the heater 20 continues to that of the supply path 28 adjacent to the first bubbling chamber 29 and parallel to the main surface on the same plane up to the supply port 19.

One end of the supply path 28 is connected to the first bubbling chamber 29, and the other end thereof is connected to the supply chamber 18. A height of the supply path 28 from the main surface of the element substrate 11 is set to be equal to or less than that to the upper end surface of the second bubbling chamber 30.

Moreover, as shown in FIGS. 4 and 5, an inner wall surface of each nozzle 27 facing the main surface of the element substrate 11 is parallel to the main surface of the element substrate 11 ranging from the supply port 19 to the first bubbling chamber 29. The nozzle 27 is also formed in such a manner that a discharge direction of the ink droplets discharged from the discharge port 26 crosses a flow direction of the ink flowing through the supply path 28 at right angles. In the nozzle 27, a sectional area of the channel extending from the discharge port 26 to the supply chamber 18 may change in a plurality of stages.

Furthermore, in the supply chamber 18, a columnar nozzle filter (not shown) for filtering and removing dust in the ink stands ranging from the element substrate 11 to the orifice substrate 12 in a position adjacent to the supply port 19 for each nozzle 27. This nozzle filter is disposed in a position distant from the supply port 19 by, for example, about 20 μm. An interval between the nozzle filters in the supply chamber 18 is set to, for example, about 10 μm. This nozzle filter prevents the supply path 28 and the discharge port 26 from being clogged with the dust, and a satisfactory discharge operation is secured.

Next, there will be described an operation of the liquid discharge head to discharge the ink droplets from the discharge ports 26.

First, in the liquid discharge head, the ink supplied into the supply chamber 18 is supplied from the supply port 19 to the respective nozzles 27 of the first and second nozzle rows 16 and 17. The ink supplied from each nozzle 27 flows along the supply path 28 to fill the first bubbling chamber 29. The ink charged in the first bubbling chamber 29 is flied in a direction crossing the main surface of the element substrate 11 substantially at right angles by a bubble growth pressure generated by film boiling by the heater 20. The ink is discharged as the ink droplets from the discharge port 26 of the discharge port portion 25.

A method of manufacturing the liquid discharge head constituted as described above will be briefly described with reference to FIGS. 8A to 8E, FIGS. 9A to 9C, FIGS. 10A and 10B and FIGS. 11A to 11F. It is to be noted that FIGS. 11A to 11F are vertically sectional views crossing, at right angles, the laterally sectional views shown in FIGS. 8A to 8E, FIGS. 9A to 9C and FIGS. 10A and 10B.

Figure 8A:
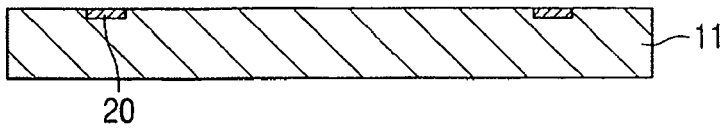
FIGS. 8A, 8B, 8C, 8D, and 8E are laterally sectional views showing first and second manufacturing steps of the liquid discharge head according to the present embodiment.
Figure 8B:
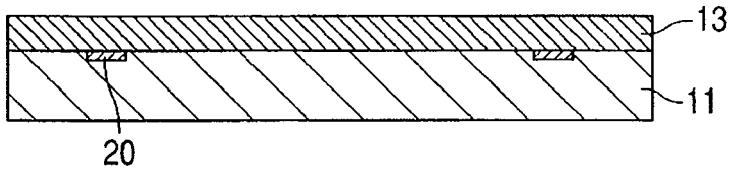
Figure 8C:
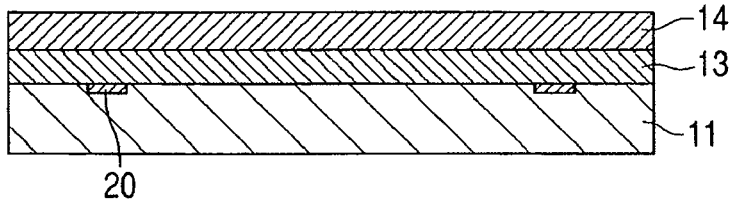
Figure 11A:
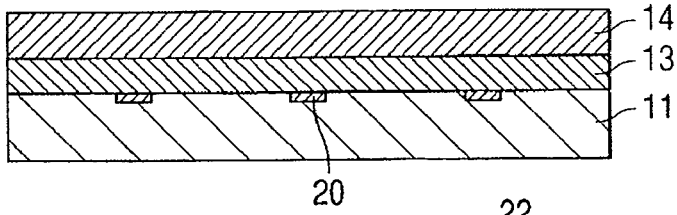
FIGS. 11A, 11B, 11C, 11D, 11E and 11F are vertically sectional views showing the respective manufacturing steps of the liquid discharge head according to the present embodiment.

As shown in FIG. 8A, a first step is a step of coating the element substrate 11 whose main surface is provided with the heaters 20 with a soluble positive resist constituting the first bubbling chamber 29, the supply path 28, and the second bubbling chamber 30. As shown in FIG. 8B, the main surface of the element substrate 11 on which the heaters 20 are arranged is coated with a soluble first positive resist 13 containing polymethyl isopropenyl ketone (PMIPK) as a main component by a spin coating process. Subsequently, as shown in FIGS. 8C and 11A, the first positive resist 13 is coated with a soluble second positive resist 14 containing, as a main component, polymethacrylate (PMMA) including ester methacrylate by the spin coating process.

Figure 8D:
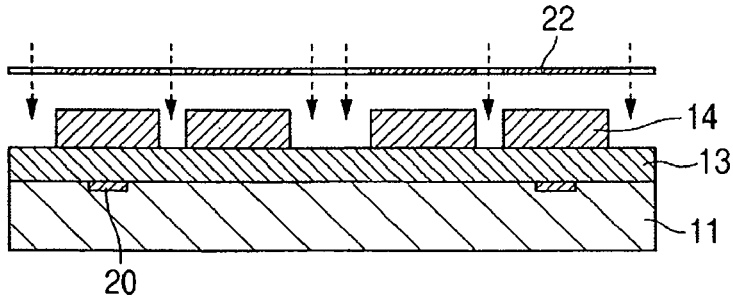
Figure 11B:
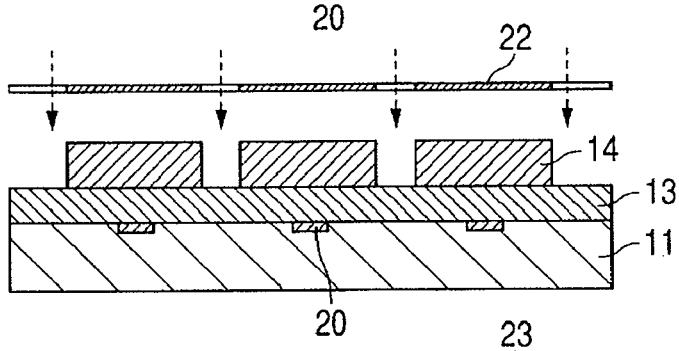

A second step is a step of pattern-forming the second bubbling chamber 30 and the first bubbling chamber 29 into the above-described characteristic shapes of the present invention. As shown in FIGS. 8D and 11B, a shield filter which interrupts deep-UV light having a wavelength of 260 nm or more is attached as wavelength selecting means to an exposure device (manufactured Ushio Inc.: UX-3000SC) to thereby pass an only wavelength that is less than 260 nm. Moreover, the second positive resist 14 of polymethacrylate (PMMA) including ester methacrylate is irradiated with the deep-UV light having a wavelength in the vicinity of 210 to 260 nm, and exposed using a mask 22 to develop an image. Accordingly, upper layer portions of the second bubbling chamber 30 and the supply path 28 are patterned.

Figure 8E:
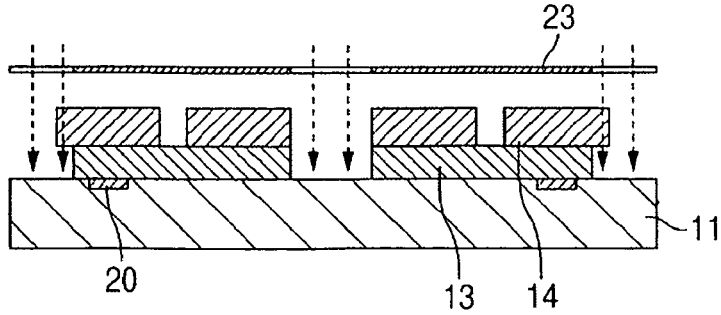
Figure 11C:
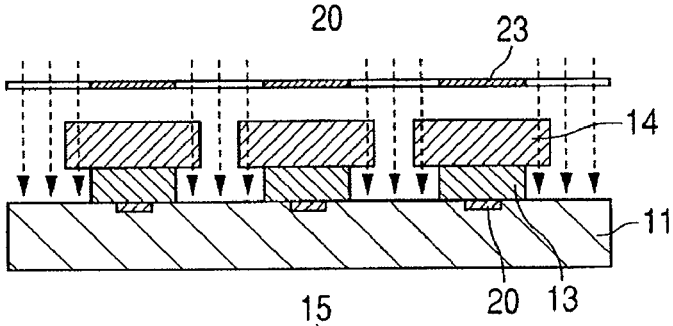

Next, as shown in FIGS. 8E and 11C, a shield filter which interrupts deep-UV light having a wavelength less than 260 nm is attached as the wavelength selecting means to the exposure device (manufactured Ushio Inc.: UX-3000SC) to thereby pass an only wavelength that is not less than 260 nm. Moreover, the first positive resist 13 containing PMIPK as the main component is irradiated with near-UV light having a wavelength in the vicinity of 260 to 330 nm, and exposed using a mask 23 to develop an image. Accordingly, lower layer portions of the first bubbling chamber 29 and the supply path 28 are patterned. Here, PMIPK is used in the first positive resist, and PMMA is used in the second positive resist. However, in the present invention, even when the first positive resist is changed to PMMA and the second positive resist is changed to PMIPK, there is not any problem as long as the patterning can be selectively performed.

Figure 9A:
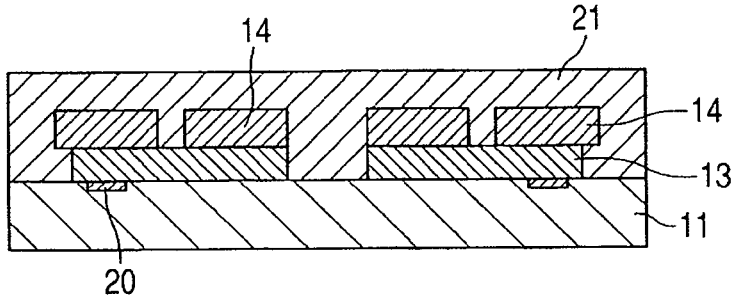
FIGS. 9A, 9B, and 9C are laterally sectional views showing a third manufacturing step of the liquid discharge head according to the present embodiment.
Figure 9B:
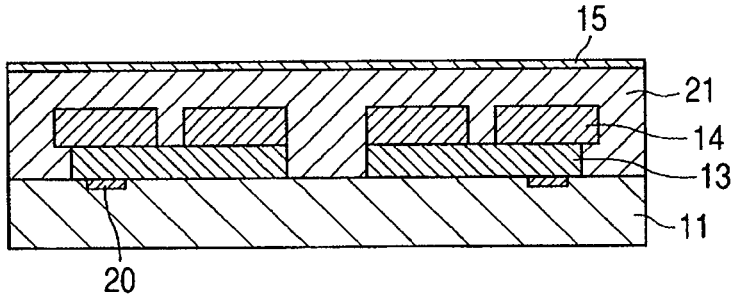
Figure 9C:
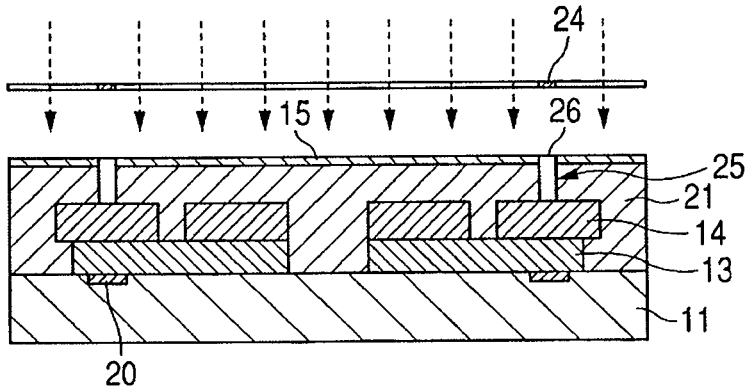
Figure 11D:
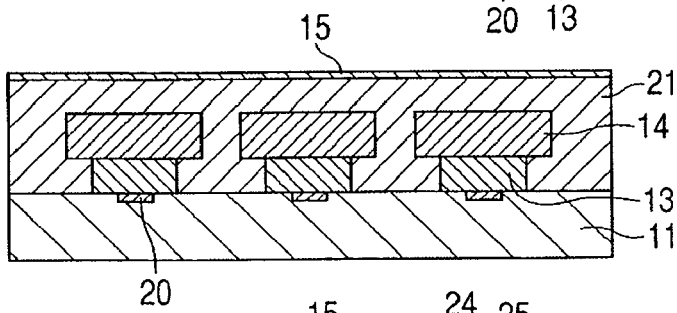
Figure 11E:
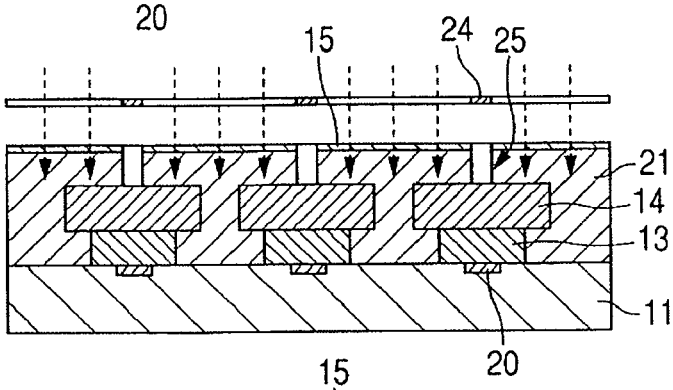

A third step is a step of forming the discharge ports 26 in the orifice substrate 12. As shown in FIG. 9A, an epoxy resin 21 including a cationic photopolymerization intiator is applied as a material of the orifice substrate 12 by the spin coating process, and pre-baked at 90° C. for three minutes. Subsequently, as shown in FIGS. 9B and 11D, a water-repellent material 15 which repels the ink is applied by a direct coating process. Thereafter, as shown in FIGS. 9C and 11E, the material is exposed with an exposure amount of 0.2 J/cm$^2$ by use of an exposure device (manufactured by Cannon Inc.: Mask Aligner MPA-600 super) and a mask 24. Thereafter, the discharge port portion 25 is formed by performing post exposure bake (PEB) and developing. Thereafter, the material is heated at about 100° C. and charged into an oven to half-cure the epoxy resin 21.

Figure 10A:
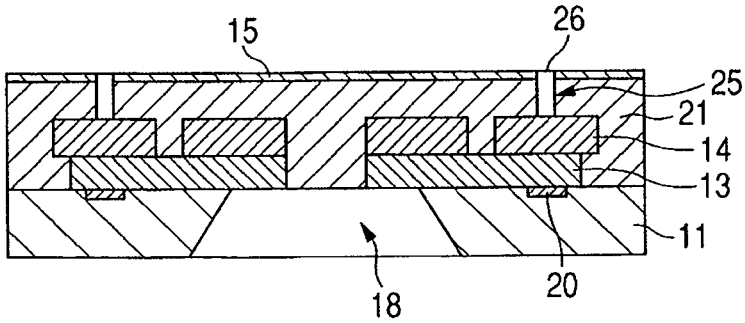
FIGS. 10A and 10B are laterally sectional views showing a fourth manufacturing step of the liquid discharge head according to the present embodiment.

A fourth step is a step of forming each nozzle 27 containing a channel from the supply port 19 to the discharge port 26. The whole surface of the orifice substrate 12 is coated with cyclized isoprene in order to protect the surface from an alkali solution. Subsequently, as shown in FIG. 10A, the element substrate 11 of silicon is immersed into tetramethyl ammonium hydride (TMAH) having a concentration of 22% at 83° C. for 16 hours to form the supply port 19. Moreover, silicon nitride for use as a mask and a membrane for forming the supply port 19 is patterned beforehand on the element substrate 11. After performing anisotropic etching in this manner, the element substrate 11 is attached to a dry etching device while the bottom surface of the element substrate is turned upwards, a membrane film is removed with a mixed gas obtained by mixing a $CF_4$ gas with 5% of oxygen, and cyclized isoprene is removed with xylene.

Thereafter, the whole surface of the orifice substrate 12 is irradiated with an ionizing radiation having a wavelength which is not more than 330 nm by use of a low-pressure mercury lamp to cause a decomposing reaction between the first positive resist 13 containing PMIPK as the main component and the second positive resist 14 containing PMMA as the main component. Subsequently, the whole element substrate 11 is immerged into methyl lactate, and the respective resists 13 and 14 are collectively removed.

Figure 10B:
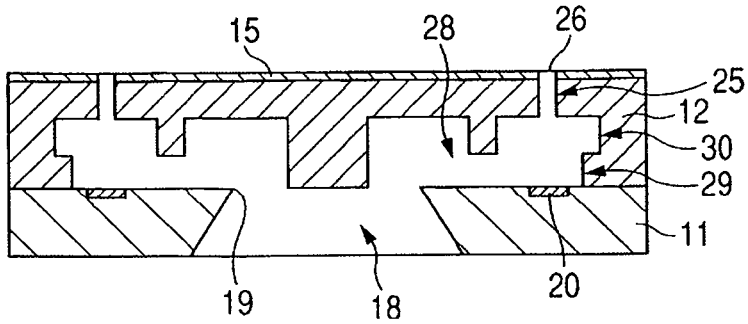
Figure 11F:
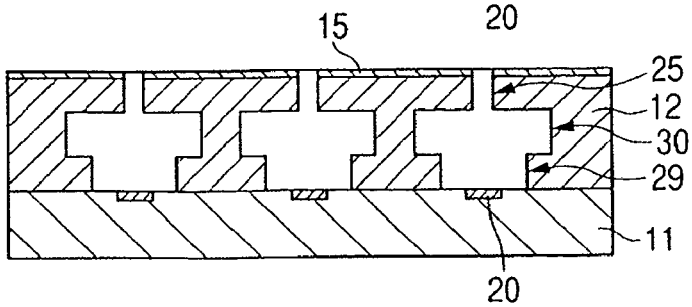

Finally, the epoxy resin 21 constituting the orifice substrate 12 is heated at about 200° C., and completely cured in the oven to thereby prepare the liquid discharge head as shown in FIGS. 10B and 11F.

As described above, in the liquid discharge head of the present embodiment, the height, width, or sectional area of the channel changes in the nozzle 27. Moreover, a volume of the ink increases once in the second bubbling chamber 30 along a direction from the main surface of the element substrate 11 to the discharge port 26. Moreover, the vicinity of the discharge port 26 is constituted in such a manner that the discharged ink droplets are discharged in a direction perpendicular to the main surface of the element substrate 11 in a case where the ink droplets are discharged.

According to the liquid discharge head of the present embodiment, since the average sectional area S2 of the second bubbling chamber 30 is larger than that of the average sectional area S1 of the first bubbling chamber 29, the ink is inhibited from being evaporated on the surface of the discharge port 26, discharge impossibility by thickening of the ink is avoided, and stability of the discharge operation can be enhanced. Furthermore, according to the liquid discharge head, a degree of freedom of the component or the viscosity of the ink for use can be enhanced, and recording (printing) with a more satisfactory quality level can be performed. Consequently, the discharge characteristics, and reliability of the discharge operation can be enhanced.

It is to be noted that although not shown, a part of the upper surface of the supply path 28 parallel to the main surface of the element substrate 11 is set to be higher than the upper surface of the supply path 28 which continues to the upper end surface of the first bubbling chamber 29 in the same plane, and connected to the upper surface through the stepped portion. Here, a maximum height from the main surface of the element substrate 11 of the supply path 28 may be set to be lower than the height from the main surface of the element substrate 11 to the upper end surface of the second bubbling chamber 30.

Moreover, a sum of volumes of the first bubbling chamber 29, the second bubbling chamber 30, and the discharge port 26 may be smaller than the volume of the supply path 28.

Embodiments will be described hereinafter. Since a basic constitution of each example is similar to that of the above-described embodiment, a constitution different from that of the embodiment will be described.

EXAMPLE 1

The above-described liquid discharge head has a structure in which the bubbles generated by heating the heaters 20 communicate with the outside air through the discharge ports 26 as representatively shown in FIGS. 4, 5, and 11F. Therefore, the volumes of the ink droplets discharged from the discharge ports 26 largely depend on a total volume of the ink with which the first bubbling chamber 29, the second bubbling chamber 30, and the discharge port portion 25 are filled. In other words, the volumes of the discharged ink droplets are substantially determined by a structure of a nozzle 27 portion of the liquid discharge head.

Therefore, according to the liquid discharge head of the present example, an image having a high quality level can be recorded without any ink unevenness. It is to be noted that in the liquid discharge head of Example 1, the shortest distance OH between the main surface of the heater 20 and the discharge port 26 is set to 30 μm or less in order to vent the bubbles to the outside air. As described above, when the volume of the second bubbling chamber 30 is set to be comparatively large, the liquid discharge head can fly the ink droplets with a stable discharge amount.

EXAMPLE 2

Figure 12:
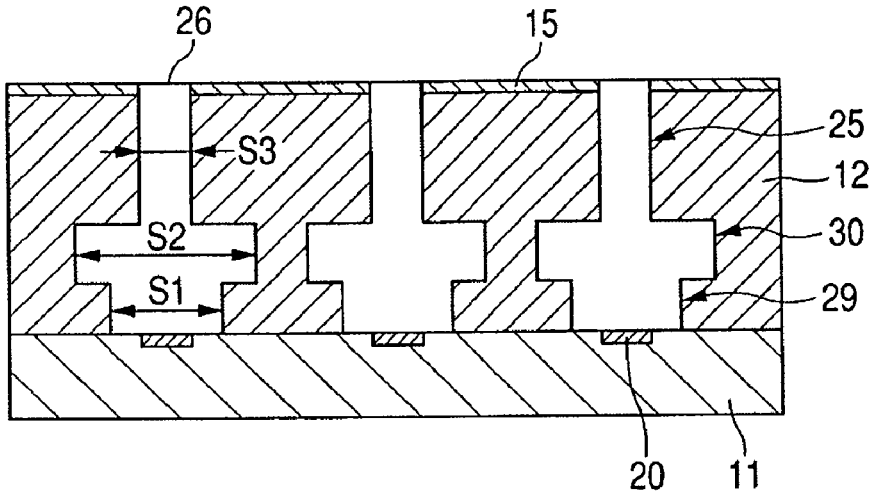
FIG. 12 is a vertically sectional view showing a structure of a liquid discharge head according to Embodiment 2.

In a liquid discharge head of the present example, as shown in a structure of FIG. 12, a length of each discharge port portion 25 parallel to a thickness direction of the orifice substrate 12 is large as compared with the liquid discharge head of Example 1. That is, the shortest distance OH between the main surface of the heater 20 and the discharge port 26 is lengthened. In the present example, the shortest distance OH is set to about 30 μm to 75 μm. Accordingly, as to the volume of each discharge port portion 25, a structure is formed in which the average sectional area S1 of the first bubbling chamber 29, the average sectional area S2 of the second bubbling chamber 30, and the average sectional area S3 of the discharge port portion 25 satisfies a relation of S2>S1>S3 in the same manner as in Example 1.

In a case where the discharge port portion 25 is formed into an elongated cylindrical shape, the ink is usually easily secured by evaporation. However, according to the liquid discharge head of the present example, it is possible to record an image without any discharge defect in the same manner as in Example 1. As described above, according to the liquid discharge head, when the average sectional area S2 of the second bubbling chamber 30 is set to be large, the ink droplets can be flied with a stable discharge amount.

EXAMPLE 3

Figure 13:
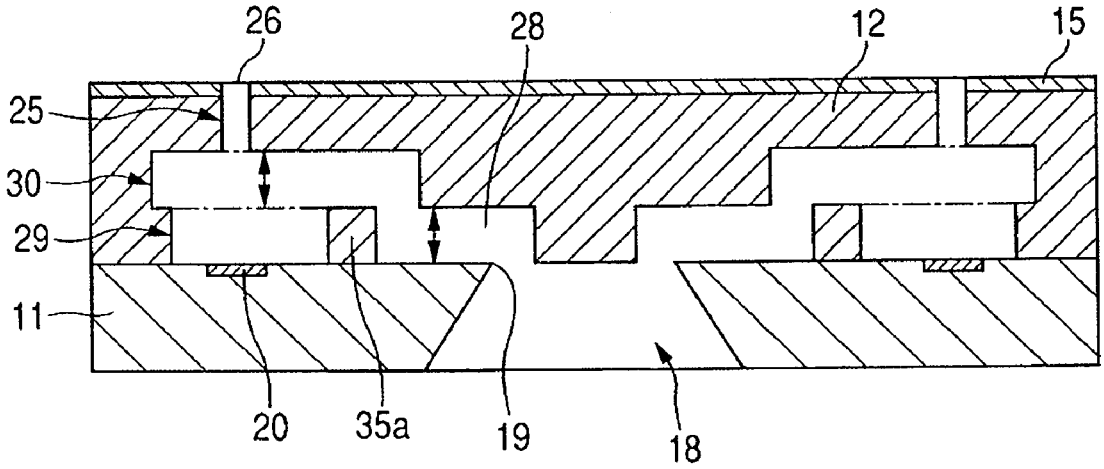
FIG. 13 is a laterally sectional view showing a structure of a liquid discharge head according to Embodiment 3.
Figure 14:
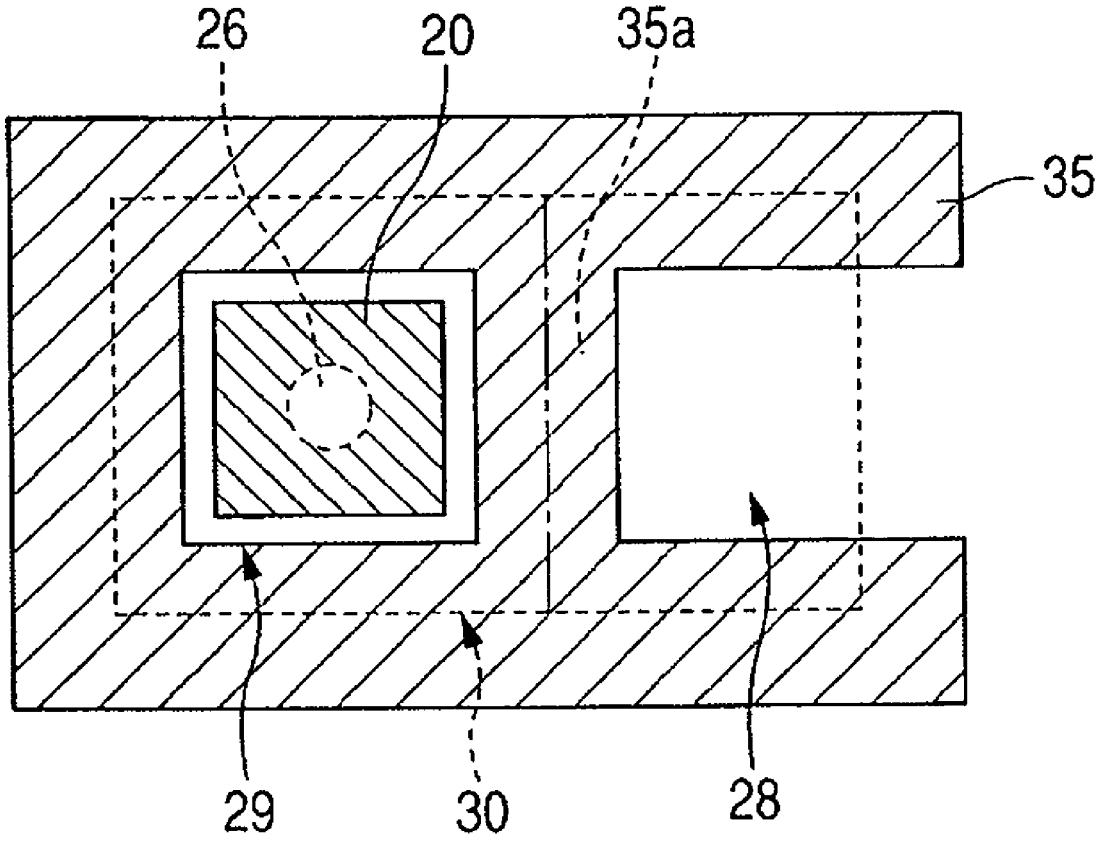
FIG. 14 is a plan view showing the structure of the liquid discharge head according to Embodiment 3.

In the liquid discharge head of the present example, as shown in representative structures of FIGS. 13 and 14, a part 35*a* of the nozzle wall 35 is protruded and isolated between the supply path 28 and the first bubbling chamber 29. Moreover, the discharge port portion 25 and the first bubbling chamber 29 are filled with the ink supplied from the supply port 19 through the second bubbling chamber 30. Therefore, according to this liquid discharge head, a refill time after the bubbling is shortened as compared with that of the conventional liquid discharge head, and higher-speed recording is possible.

This application claims priority from Japanese Patent Application No. 2004-348614 filed Dec. 1, 2004, which is hereby incorporated by reference herein.

What is claimed is:

1. A liquid discharge head comprising:

a discharge energy generating element which generates energy for discharging liquid droplets;

an element substrate on which the discharge energy generating element is disposed;

a nozzle having a discharge port which discharges the liquid droplets, a bubbling chamber in which bubbles are generated by the discharge energy generating element, and a supply path for supplying a liquid to the bubbling chamber; and an orifice substrate having the nozzle and a supply chamber for supplying the liquid to the nozzle, and bonded to a main surface of the element substrate, the bubbling chamber comprising a first bubbling chamber which is connected to the supply path with a main surface of the element substrate forming a bottom surface thereof and in which the bubbles are generated in the liquid by the discharge energy generating element, and a second bubbling chamber connected to the first bubbling chamber, the nozzle having a discharge port portion including the discharge port connected to the second bubbling chamber, and satisfying a relation of S2>S1>S3, wherein an average sectional area of the first bubbling chamber is S1, an average sectional area of the second bubbling chamber is S2, and an average sectional area of the discharge port portion is S3 in sections parallel to the main surface of the element substrate, and wherein the first bubbling chamber, the second bubbling chamber and the discharge port portion are formed in the orifice substrate.

2. The liquid discharge head according to claim 1, wherein the first bubbling chamber is connected to the second bubbling chamber through a stepped portion, a sectional area of the second bubbling chamber is larger than that of the first bubbling chamber in the sections parallel to the main surface of the element substrate, the second bubbling chamber is connected to the discharge port portion though a stepped portion, and the sectional area of the second bubbling chamber is larger than that of the discharge port portion.

3. The liquid discharge head according to claim 1, wherein a height of the supply path from the main surface of the element substrate is not more than that of the supply path to an upper end surface of the second bubbling chamber.

4. The liquid discharge head according to claim 1, wherein the first and second bubbling chambers are surrounded with nozzle walls for partitioning a plurality of nozzles arranged in parallel with one another into individual nozzles in three directions, wall surfaces of the first bubbling chamber and the supply path are inclined by a tilt angle of 45° or less with respect to a plane crossing the main surface of the element substrate at right angles, and the first bubbling chamber and the supply path are reduced in area in a direction toward the discharge port.

5. The liquid discharge head according to claim 1, wherein the first and second bubbling chambers are surrounded with nozzle walls for partitioning a plurality of nozzles arranged in parallel with one another into individual nozzles in three directions, a wall surface of the second bubbling chamber is inclined by a tilt angle of 45° or less with respect to a plane crossing the main surface of the element substrate at right angles, and the second bubbling chamber is reduced in area in a direction toward the discharge port.

6. The liquid discharge head according to claim 1, wherein the orifice substrate is provided with a plurality of nozzles corresponding to a plurality of discharge energy generating elements, the plurality of nozzles are divided into a first nozzle row in which the respective nozzles are arranged in parallel with one another in a longitudinal direction and a second nozzle row disposed in a position facing the first nozzle row through the supply chamber, and a pitch between the adjacent nozzles in the second nozzle row deviates by a ½ pitch from that between the adjacent nozzles in the first nozzle row.

7. The liquid discharge head according to claim 6, wherein the first nozzle row is different from the second nozzle row in a discharge amount of the liquid droplets discharged from respective discharge ports.

8. The liquid discharge head according to claim 6, wherein the first nozzle row is different from the second nozzle row with respect to areas of the discharge energy generating elements parallel to the main surface of the element substrate.

9. The liquid discharge head according to claim 6, wherein the shortest distance between each discharge energy generating element and corresponding discharge port in the first nozzle row is formed to be equal to that between each discharge energy generating element and corresponding discharge port in the second nozzle row.

* * * * *